US006663726B2

(12) United States Patent
Abe et al.

(10) Patent No.: US 6,663,726 B2
(45) Date of Patent: Dec. 16, 2003

(54) HIGH-HARDNESS PREHARDENED STEEL FOR COLD WORKING WITH EXCELLENT MACHINABILITY, DIE MADE OF THE SAME FOR COLD WORKING, AND METHOD OF WORKING THE SAME

(75) Inventors: Yukio Abe, Ichikawa (JP); Hideshi Nakatsu, Yasugi (JP); Yasushi Tamura, Yasugi (JP); Yoshihiro Kada, Yonago (JP)

(73) Assignee: Hitachi Metals, Ltd., Tokyo (JP)

( * ) Notice: Subject to any disclaimer, the term of this patent is extended or adjusted under 35 U.S.C. 154(b) by 0 days.

(21) Appl. No.: 10/012,503

(22) Filed: Dec. 12, 2001

(65) Prior Publication Data

US 2002/0112786 A1 Aug. 22, 2002

(30) Foreign Application Priority Data

Dec. 13, 2000 (JP) ..... 2000-379222

(51) Int. Cl.[7] ..... C22C 38/60; C22C 38/22; C22C 38/24; C22C 38/44; C21P 9/00

(52) U.S. Cl. ..... 148/320; 148/333; 148/334; 148/325; 148/663; 420/42; 420/87

(58) Field of Search ..... 420/42, 87, 104, 420/105; 148/320, 333, 334, 325, 663

(56) References Cited

FOREIGN PATENT DOCUMENTS

| | | | | |
|---|---|---|---|---|
| JP | A-01-201424 | | 8/1989 | |
| JP | 407232256 A | * | 9/1995 | ..... B22D/17/22 |
| JP | A-11-92871 | | 4/1999 | |
| JP | A-11-279704 | | 10/1999 | |
| JP | A-2000-192195 | | 7/2000 | |
| JP | A-2001-316769 | | 11/2001 | |

OTHER PUBLICATIONS

Abstract of JP A–11–92871, Apr. 6, 1999, Junji et al.

Abstract of JP A–01–201424, Aug. 14, 1989, Yoshiyuki et al.

Abstract of JP A–11–279704, Oct. 12, 1999, Junji et al.

Abstract of JP A–2000–192195, Jul. 11, 2000, Seiji et al.

* cited by examiner

*Primary Examiner*—Deborah Yee
(74) *Attorney, Agent, or Firm*—Sughrue Mion, PLLC

(57) ABSTRACT

There are provided a high-hardness prehardened steel for cold working having excellent machinability containing, by mass, not less than 0.3% but less than 0.5% C, 0.7 to 2.0% Si, and 0.08 to 0.25% S, a die for cold working which is fabricated by cutting this prehardened steel at a cutting speed not less than 50 m/min. This steel is hardened and tempered to have a hardness not less than 50 HRC. Preferably, this steel consists, by mass, not less than 0.3% but less than 0.5% C, 0.7 to 2.0% Si, 0.1 to 2.0% Mn, 0.08 to 0.25% S, 0.5 to 15.0% Cr, at least one selected from the group consisting of W and Mo an amount of which one is not more than 3.5% in total in terms of (Mo+1/2W), not more than 4.0% V, not more than 0.15% N, and the balance Fe and incidental impurities.

21 Claims, 1 Drawing Sheet

HIGH-HARDNESS PREHARDENED STEEL FOR COLD WORKING WITH EXCELLENT MACHINABILITY, DIE MADE OF THE SAME FOR COLD WORKING, AND METHOD OF WORKING THE SAME

BACKGROUND OF THE INVENTION

The present invention relates to a high-hardness prehardened steel for cold working which is used for producing dies etc. for the blanking, bending, drawing and trimming of steel sheets used in automobiles, home electric appliances, printed circuit boards, agricultural implements, etc., a die made of this steel, and a method of working this steel which contributes to the achievement of these means.

Working such as blanking is used in the manufacture of parts of automobiles, home electric appliances etc. Die materials used in dies and, in particular, die materials for cold working contain large amounts of carbides in order to provide wear resistance and, Further, materials which have high chromium contents are required to ensure excellent hardenability and toughness. For example, high-C and high-Cr steels such as JIS-SKD11, which is an alloy tool steel specified in JIS G4404, are used for this purpose. When wear resistance is not particularly required, low-alloy steels such as JIS-SKS3 are also used in a hardened, tempered state by conducting tempering at a temperature of not more than 300° C. after oil hardening.

In recent years, however, automakers etc. have carried out cost reductions in every field in order to beat their price competition and it has become necessary to reduce die-fabrication man-hours in the working related to the fabrication of dies. On the other hand, as a general social trend, there is a shift to small-amount-and-many kinds production and, from this viewpoint, a matter of concern has been placed on how rapidly dies can be fabricated.

In the present usual fabrication of dies, materials in an annealed state are subjected first to the rough working of a shape mainly by cutting work and then to the hardening and tempering treatment in order to increase their hardness to a level necessary for the working of products such as blanking. When the hardening and tempering treatment is performed, changes in size and deformation occur due to the heat treatment. Therefore, the fabrication of the dies is completed by performing finish working such as cutting and grinding. For this reason, in order to improve the die-fabrication efficiency, it is desirable that machinability in an annealed state be good and simultaneously that changes in size and deformation due to heat treatment be small, and a tool steel for cold working as described in JP-A-11-92871 is proposed.

However, since further reduction in both of man-hours for the die fabrication and the cost of the die fabrication is required at present, the need for so-called "prehardened steels" is increasing. In the prehardened steels, the die-fabrication efficiency can be increased because the cutting work is performed in a hardened and tempered state of the steel while omitting the heat treatment and finish working both having been usually performed after the cutting work.

At present, die fabrication by use of the prehardened steel is performed in the fields of a part of plastic dies and a hot-forging die etc. However, the hardness of such dies is about 40 HRC and does not reach hardness a level not less than 50 HRC which is required in blanking etc. by cold working. This is because the higher the hardness thereof is, the higher both of the resistance and impact applied to tools becomes during cutting, and these resistance and impact exceed the strength of the tools, with the result that the early breaks thereof occur, reaching tool life.

On the other hand, in the field of the cutting work the improvement in the cutting efficiency has advanced because of high-speed cutting. However, in the high-speed cutting of high-hardness materials exceeding 50 HRC, the softening of tools or the fusing-and-adhering of worked material onto the tools is accelerated by an excessive rise in the cutting temperature in addition to the above impact to the tools, so that the premature termination of the tool life also occurs. In a conventional tool steel for cold working, that is, JIS-SKD11, there are many cases where it becomes impossible, for the reasons disclosed above, for this tool steel to satisfy the requirements for the die-fabrication efficiency and tool life which requirements arise from the standpoint of the shortening of man-hours of die fabrication, insofar as the cutting work is concerned which is performed in the high-hardness state achieved after the hardening and tempering.

Further, the steel of JIS-SKS3 does not always meet the requirement for an improvement in the die-fabrication efficiency although its machinability in the hardened and tempered state is good in comparison with the steel of JIS-SKD11. In addition, because this steel is an oil-hardening and low-temperature tempered steel, it poses the problem of the occurrence of strain during electric discharge machining which is often used in die fabrication instead of the cutting work.

As explained above, in the tool steels conventionally used for producing dies etc., it is practically difficult to perform the cutting work in the prehardened state of the tool steels with the hardness level not less than 50 HRC.

SUMMARY OF THE INVENTION

The object of the invention is to obtain a tool steel having an improved machinability after hardening and tempering so that working in the prehardened state thereof may become possible, a die made of this steel, and a method of working this steel which contributes to the achievement of these means.

After the present inventors have performed intensive research regarding the chemical compositions of steel which bring about both of a high hardness level not less than 50 HRC and good machinability at this high hardness level, they have found an appropriate composition balance and have achieved the present invention.

According to the first aspect of the invention, there is provided a high-hardness prehardened steel for cold working, which contains, by mass, not less than 0.3% but less than 0.5% C, 0.7 to 2.0% Si, and 0.08 to 0.25% S, the steel being hardened and tempered to a hardness not less than 50 HRC and preferably to a hardness not less than 55 HRC.

According to the second aspect of the invention, there is provided a high-hardness prehardened steel for cold working, which consists, as its specific chemical composition, by mass, not less than 0.3% but less than 0.5% C, 0.7 to 2.0% Si, 0.1 to 2.0% Mn, 0.08 to 0.25% S, 0.5 to 15.0% Cr, at least one selected from the group consisting of W and Mo the total content of which at least one is not more than 3.5% in terms of (Mo+1/2W), not more than 4.0% V, not more than 0.15% N, and the balance Fe and incidental impurities.

According to the third aspect of the invention, there is provided a high-hardness prehardened steel for cold working, which consists, by mass, of 0.3% to 0.45% C, 0.8 to 2.0% Si, 0.1 to 2.0% Mn, 0.08 to 0.25% S, 4.0 to 6.0% Cr, at least one selected from the group consisting of W and Mo the total content of which at least one is not more than 2.0% in terms of (Mo+1/2W), not more than 1.0% V, not more than 0.15% N, and the balance Fe and incidental impurities.

According to the fourth aspect of the invention, there is provided a high-hardness prehardened steel for cold working, which contains in addition to the above components: at least one selected from the group consisting of Nb, Ta and Ti the total contents of which at least one is not more than 0.4% by mass; and at least one selected from the group consisting, by mass, of not more than 4.0% Ni, not more than 2.0% Cu, not more than 5.0% Co, not more than 0.2% Zr, not more than 0.15% Se, not more than 100 ppm Ca, and not more than 1.5% Al.

According to the fifth aspect of the invention, there is provided a high-hardness prehardened steel for cold working, which is used after being subjected to cutting work in the above hardened-and-tempered state and in which the speed of the cutting is not less than 50 m/min.

According to the sixth aspect of the invention, there is provided a die for cold working which is fabricated by cutting the high-hardness prehardened steel for cold working.

The attainment of both of the prehardened steel and the die for cold working of the invention is also greatly attributed to the establishment of optimum conditions for prolonging the service life of cutting tools in the cutting of the steel hardened and tempered to the high hardness. Namely, according to the seventh aspect of the invention, there is provided a method of performing cutting work of a steel hardened and tempered to a hardness not less than 50 HRC which cutting work is performed at a cutting speed not less than 50 m/min, the steel to be worked containing, by mass, not less than 0.3% but less than 0.5% C, 0.7 to 2.0% Si, and 0.08 to 0.25% S.

DETAILED DESCRIPTION OF THE PREFERRED EMBODIMENTS

Figure 1:
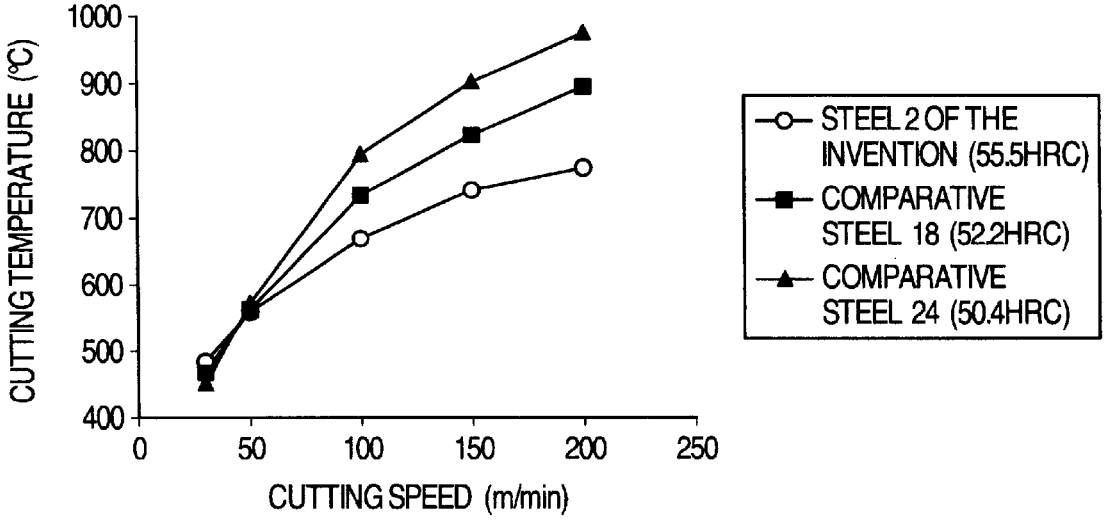
FIG. 1 shows how the cutting temperature increases with increasing cutting speed in order to explain an example of the effect of the invention.

A feature of the invention is that the components of the steel, in particular, the contents of C, Si and S are optimized so that a hardness not less than 50 HRC or preferably another hardness not less than 55 HRC may be obtained and so that the machinability thereof becomes good in a high-hardness state achieved after the hardening and tempering. The reasons for the limitation of the components in the invention are described below.

C(carbon) is an important element in the invention. C is necessary for improving the hardenability and keeping the high hardness after the heat treatment. Further, C combines with Cr, Mo, W and V to thereby form carbides, whereby the wear resistance and resistance to temper softening is improved. In addition, this element is important for forming MX-type compounds (TiC, VC, etc.) with a sufficient film thickness during the surface treatment performed to impart wear resistance to the steel.

However, in order to improve the machinability in the high hardness after the hardening and tempering, it is important to lower the C content. In the high hardness not less than 50 HRC, the temperature of the worked steel increases during the cutting, and a tool is softened, reaching the termination of its tool service life. Further, the fusing-and-adhering of the worked steel to the cutting tool increases. In this case, when fused, adhered matters are exfoliated, the exfoliation of a tool portion simultaneously occurs in the tool, and the premature termination of a tool service life occurs due to the chipping and break of the tool.

In order to improve the machinability, the controlling of the morphology of sulfides by adding S(sulfur) or Te(tellurium) etc. is used, however, the present inventors have found that the lowering of the C content is important for suppressing a decrease in machinability occurring due to the rise of the cutting temperature in the high hardness. By reducing the amount of C, the excessive rise in the cutting temperature at the time of the cutting work is suppressed, so that the machinability is improved. However, if the C content is too low, it is impossible to obtain the high hardness not less than 50 HRC. Therefore, an appropriate adjustment of the C content, that is, the lowering of the C content in such a range as the necessary hardness can be obtained is an important feature of the invention. Accordingly, the C content is limited to be not less than 0.3% but less than 0.5% and is preferably 0.3 to 0.45%.

Si(silicon) is an important element for improving the machinability. The adding of Si lowers the melting points of oxides during cutting and forms an oxide film effective in preventing the fusing-and-adhering from occurring between the tool and the steel to be worked, thereby preventing the direct contact thereof from occurring between the tool and the worked steel, with the result that the wear of the tool decreases, that is, the machinability is improved. In order to obtain this effect, it is necessary to add not less than 0.7% Si. Further, Si is added as an Si deoxidizer and to improve the castability of the steel. However, because an excessive Si content makes the component segregation of the matrix intensive and lowers the toughness, the Si content is limited to be 0.7 to 2.0%, preferably 0.8 to 2.0%, and more preferably 0.8 to 1.7%.

S(sulfur) is an important element for forming sulfides which increase the machinability. However, because an excessive S content lowers the toughness and weldability, the S content is limited to be 0.08 to 0.25%, preferably 0.1 to 0.25%, and more preferably 0.13 to 0.25%.

Next, specific chemical compositions preferred for achieving the high-hardness prehardened steel for cold working embodying the invention are described below.

Mn (manganese) is added to improve the hardenability, and a Mn content less than 0.1% is insufficient for obtaining the quenching hardness in a stable manner. Further, Mn is necessary for forming MnS which is a sulfide improving the machinability. On the other hand, an excessive Mn content makes the component segregation of the matrix intensive similarly to Si, the Mn content is limited to be 0.1 to 2.0%, and preferably 0.6 to 1.5%.

Cr combines with C to thereby form carbides, improving the wear resistance and has simultaneously an effect of increasing the hardenability and another effect of preventing a kind of quenching crack phenomenon from occurring during the cooling after such a surface treatment to complex shapes as to be performed by CVD (chemical vapor deposition) treatment and salt bath process. However, an excessively high-Cr content causes a decrease in the toughness and machinability due to an increase in Cr carbides. Further, an excessively high-Cr content widens the temperature range of solid-liquid coexistence, thereby increasing the risk of the occurrence of casting defects and substantially causing difficulties in manufacturability. Therefore, the Cr content is limited to be 0.5 to 15.0% and preferably 4.0 to 6.0% in the attainment of the invention.

Mo (molybdenum) and W (tungsten) improve the hardenability. Further, these elements combine with C to thereby form hard carbides, whereby the wear resistance is improved. The effects brought about by Mo and W regarding each of the characteristics are similar to each other, and the degree of the effects of Mo is equivalent to twice that of W by mass ratio. Accordingly, the Mo and W contents contributing to the effects can be expressed by the (Mo+1/2W) contents. In the invention, at least one of Mo and W may be added. In other words, the whole Mo content may be replaced with a W content which is twice the Mo content, or a part of Mo may be replaced with a corresponding W content. The use of Mo is desirable in view of the cost efficiency. An excessive Mo or W content increases the amounts of crystallized Mo- or W-base carbides, thereby decreasing the machinability and toughness. Therefore, the Mo and/or W content is limited to be not more than 3.5%, preferably not more than 2.0%, and the more preferred content range thereof is 0.2 to 1.1%.

V (vanadium) is an element increasing the resistance to softening necessary for the tool steel. An excessive V content causes huge V-base carbides to be crystallized during the solidification, thereby causing a decrease in machinability. Therefore, the V content is limited to be not more than 4.0%, preferably not more than 1.0%, and the more preferable range thereof is 0.1 to 0.5%.

N (nitrogen) exists in the matrix or the carbides in a solid solution state and refines grains, thereby increasing the toughness. Further, this element increases the quenching-tempering hardness. In the invention, it does not matter whether N is added or originally contained. However, in order to obtain the above effect, it is unnecessary to add a much amount of N, and the N content is limited to be not more than 0.15% in view of the restriction of the solid solution limit. In a case where the above effect is to be obtained, an N content not less than 0.01% is sufficient, and preferably, the N content is not less than 0.02%.

In addition, in the case of the high-hardness prehardened steel for cold working according to the invention, the elements described below may be added.

Each of Nb (niobium), Ta (tantalum) and Ti (titanium) suppresses the growth of the grains during the heating-and-holding for performing the hardening, makes the grains fine in size and increase the toughness of the steel. However, an excessive amount regarding each of Nb, Ta and Ti makes coarse carbides formed and decreases the toughness. Therefore, the total amount of Nb, Ta and Ti contents is not more than 0.4%. In a case where the above effect is to be obtained, the total amount of Nb, Ta and Ti contents is preferably not less than 0.008%.

Ni (nickel) is an element improving the hardenability and raising the impact transition temperature, because of which the toughness is improved. In the steel of the invention, Ni acts particularly to prevent the weldability from being deteriorated and acts to enlarge the range of surface treatment capable of being applied to a practical operation. However, because an excessive Ni content decreases machinability, the Ni content is limited to be not more than 4.0%. In a case where the above effect is to be obtained, the Ni content is preferably not less than 0.01%.

Cu (copper) is an element improving the quenching-and-tempering hardness of the steel. Even when the C content is lowered to improve the machinability, the hardness can be ensured by adding Cu. Because an excessive Cu content deteriorates the hot workability during the production of the steel, the Cu content is limited to be not more than 2.0%. In a case where the above effect is to be obtained, the Cu content is preferably not less than 0.5%.

Co (cobalt) is an element which suppresses the agglomeration of finely precipitated carbides during the tempering, and a high hardness is obtained by this element. Therefore, even when the C content is lowered to improve the machinability, the hardness of the intended level can be ensured by adding Co. Because an excessive Co content increases the manufacturing cost, the Co content is limited to be not more than 5.0%. In a case where the above effect is to be obtained, the Co content is preferably not less than 1.0%.

Because Zr (zirconium) becomes $ZrO_2$ or ZrN which has an inoculation action effective for the sulfides, the sulfides are uniformly distributed and the machinability is improved. An excessive Zr content forms too large amounts of $ZrO_2$ or ZrN, impairing the machinability. Therefore, the Zr content is limited to be not more than 0.2%. In a case where the above effect is to be obtained, the Zr content is preferably not less than 0.005%.

Se (selenium) is an element which improves machinability by suppressing the elongation of sulfides during the forging. However, because an excessive Se content results in a deterioration in the mechanical properties, the Se content is limited to be not more than 0.15%. In a case where the above effect is to be obtained, the Se content is preferably not less than 0.03%.

Ca (calcium) is a free-cutting element which does not cause any deterioration of the mechanical properties. The free-cutting mechanism of Ca is such that this element lowers the melting points of the oxides each of which is dispersed in a minute amount in steel, with the result that these oxides are dissolved and precipitated due to cutting heat and form protective films on cutting edges. Further, Ca suppresses the elongation of the sulfides in the direction of forging and is effective in suppressing the decrease in toughness in a direction vertical to the direction of the forging. However, because Ca has a high vapor pressure, Ca is apt to come off from the molten steel, and Ca of at most about 100 ppm can be added insofar as the present technique of the adding is concerned. In a case where the above effect is to be obtained, the Se content is preferably not less than 10 ppm.

In compliance with other required effects, at least one kind of an amount not more than 0.2% in total selected from the group consisting of Pb, Te, Bi, In, Be and Ce may be contained in the steel in addition to the above components.

Rare-earth elements may be contained in an amount not more than 0.2% in total in order to improve the machinability of the steel. The total amount of incidental impurities is limited to be preferably not more than 0.5%. Further, when it is necessary to further improve the wear resistance of the steel, it is possible to increase the nitriding hardness by adding Al in an amount not more than 1.5%. In this case, in order to prevent the chipping-off of the steel and etc. from occurring due to an excessive increase in the nitriding hardness, the Al content is limited to be preferably not less than 0.07% but not more than 0.5%.

In the invention, the precipitation hardening brought about by NiAl can be used so that a hardness not less than 50 HRC or not less than 55 HRC may be obtained after the hardening and tempering even when the C content is low. In order to obtain this effect, it is effective to add Ni not more than 4.0%, Al not more than 1.5%, and Cu not more than 1.5%.

Next, the tempering temperature and the hardness obtained thereby are described below. From the standpoint of improving the wear resistance, the dies for cold working such as blanking and bending require a hardness not less than 50 HRC, preferably not less than 54 HRC, and more preferably not less than 55 HRC. Therefore, the hardness required in the invention is not less than 50 HRC and preferably not less than 55 HRC.

In the working of these dies, the electric discharge machining as well as the cutting work is also widely used. In this case, hardening strains remain in the steel if the tempering temperature is low, with the result that the strains are relieved after the electric discharge machining and may sometimes cause deformation and cracks. Further, since a surface treatment, such as nitriding and PVD, performed to impart the wear resistance to the steel is usually conducted at a temperature not less than 400° C., the tempering temperature of the steel materials must be not less than the surface treatment temperature in a case where this surface treatment is to be performed. Thus, it is preferred that the tempering in the hardening and tempering treatment be performed at a temperature not less than 500° C.

Next, the cutting speed is described below. In general, even in a case of a high-hardness material not less than 50 HRC, it is possible to perform the cutting of a certain degree by using, for an example, a coated cemented carbide end mill while making cutting speed low so that an excessive rise of the cutting temperature may be suppressed. In this method, however, man-hours for the cutting increase, with the result that it becomes impossible to improve the die fabrication efficiency. Therefore, the feature of the invention is that the excessive rise of the cutting temperature is suppressed by mainly lowering the C content, thereby improving the machinability.

Namely, in the high-hardness prehardened steel of the invention the cutting temperature dose not rise so high as the conventional steels even in a case where the cutting speed increases, so that a high-speed cutting operation becomes possible even in a high hardness not less than 50 HRC or not less than 55 HRC, whereby the improvement in the die fabrication efficiency can be achieved. In this case, in view of the die-fabrication efficiency, it is preferred that the cutting speed be not less than 50 m/min in order to ensure that the effects of the invention are brought about. The working at the cutting speed of the invention is performed particularly by end milling, face milling, lathe turning machines and etc.

As described above, in the high-hardness prehardened steel of the invention, die cutting work becomes possible with good efficiency even in the case of such a high hardness as to be not less than 50 HRC or not less than 55 HRC, so that the lead time for the fabrication of dies such as press dies can be shortened. Further, because of its high hardness and high machinability achieved in the steel of the invention, the steel can be used for a resin mold for moulding a resin containing glass which mold is required to have high wear resistance, a rubber mould, a plastic mould, and auxiliary tools such as spacers and holders for a hot-working die.

Next, the embodiments of the invention are described below in detail, however, the invention is not limited to these embodiment.

Embodiment 1

Predetermined alloys were melted in a high-frequency furnace, and steel ingots of the chemical compositions shown in Table 1 were made. The comparative steel 18 has a chemical composition equivalent to that of JIS-SKD11. These ingots were forged at a forging ratio of 5 into steel materials, which were annealed. Next, these annealed steel materials were heated and held at 1030° C. in an air furnace, which were then air-hardened and were tempered at 500 to 600° C. The hardened and tempered steel materials were finished to a size of 40×50×200 mm and were used as samples for a cutting test. In Table 1, the hardness obtained after the hardening and tempering of each of the samples is also shown. In Table 1, because the C content of the comparative steel 19 is too low, a hardness not less than 50 HRC cannot be obtained.

TABLE 1

| | Chemical composition (The unit of the numerical values is mass %, however, that of Ca is ppm.) *the balance Fe | | | | | | | | | | | Hardness |
|---|---|---|---|---|---|---|---|---|---|---|---|---|
| | No. | C | Si | Mn | S | Cr | W | Mo | V | N | Other elements* | HRC |
| Inventive Steels | 1 | 0.35 | 1.64 | 0.77 | 0.14 | 5.18 | — | 1.85 | 0.42 | 0.0072 | | 57.0 |
| | 2 | 0.39 | 1.53 | 0.97 | 0.19 | 5.05 | — | 0.56 | 0.23 | 0.0103 | | 55.5 |
| | 3 | 0.37 | 1.52 | 0.99 | 0.19 | 5.07 | — | 0.92 | 0.29 | 0.0095 | Ca: 31 | 55.3 |
| | 4 | 0.38 | 0.89 | 1.23 | 0.22 | 5.42 | — | 0.71 | 0.19 | 0.0187 | Zr: 0.09 | 55.1 |
| | 5 | 0.35 | 0.82 | 0.62 | 0.11 | 4.76 | 0.58 | 1.01 | 0.11 | 0.0077 | Se: 0.11 | 57.0 |
| | 6 | 0.41 | 1.45 | 0.87 | 0.19 | 4.83 | — | 0.86 | 0.23 | 0.0136 | | 55.6 |
| | 7 | 0.46 | 1.67 | 0.93 | 0.24 | 5.21 | — | 0.67 | 0.18 | 0.0014 | | 55.3 |
| | 8 | 0.37 | 1.13 | 0.81 | 0.18 | 4.97 | — | 0.92 | 0.20 | 0.0184 | | 56.2 |
| | 9 | 0.43 | 1.42 | 0.84 | 0.18 | 4.41 | — | 1.07 | 0.30 | 0.0101 | Ni: 0.51, Nb: 0.02 | 55.4 |
| | 10 | 0.34 | 1.48 | 0.95 | 0.22 | 4.78 | — | 1.02 | 0.22 | 0.0094 | Cu: 0.96 | 56.2 |
| | 11 | 0.36 | 1.33 | 1.04 | 0.17 | 5.42 | — | 0.78 | 0.18 | 0.0157 | | 56.1 |
| | 12 | 0.31 | 1.62 | 0.88 | 0.16 | 5.50 | — | 0.80 | 0.11 | 0.0632 | | 55.0 |
| | 13 | 0.38 | 1.63 | 0.88 | 0.24 | 5.22 | — | 0.94 | 0.16 | 0.0081 | Co: 1.01 | 56.9 |
| | 14 | 0.42 | 1.34 | 0.89 | 0.18 | 5.01 | — | 0.87 | 0.22 | 0.0107 | Ti: 0.03 | 56.0 |
| | 15 | 0.33 | 1.67 | 1.05 | 0.17 | 4.77 | — | 0.94 | 0.15 | 0.0097 | Ta: 0.05 | 55.7 |
| | 16 | 0.37 | 1.49 | 0.99 | 0.23 | 5.18 | — | 1.03 | 0.17 | 0.0135 | Nb: 0.03, Ta: 0.13, Ti: 0.08 | 55.1 |
| | 17 | 0.38 | 1.54 | 1.02 | 0.22 | 5.10 | — | 1.23 | 0.24 | 0.0114 | Al: 1.21 | 56.8 |
| Comparative Steels | 18 | 1.48 | 0.25 | 0.44 | 0.02 | 12.03 | | 0.86 | 0.25 | 0.0228 | | 52.2 |
| | 19 | 0.20 | 1.48 | 0.77 | 0.17 | 4.02 | — | 0.95 | 0.22 | 0.0097 | | 48.2 |
| | 20 | 0.72 | 1.49 | 0.56 | 0.14 | 7.54 | — | 1.33 | 0.45 | 0.0167 | | 54.4 |

TABLE 1-continued

| | Chemical composition (The unit of the numerical values is mass %, however, that of Ca is ppm.) *the balance Fe | | | | | | | | | | Hardness |
|---|---|---|---|---|---|---|---|---|---|---|---|
| No. | C | Si | Mn | S | Cr | W | Mo | V | N | Other elements* | HRC |
| 21 | 0.40 | 0.34 | 0.68 | 0.13 | 5.78 | — | 1.42 | 0.19 | 0.0152 | | 56.2 |
| 22 | 0.44 | 1.36 | 0.92 | 0.06 | 4.59 | — | 1.56 | 0.33 | 0.0086 | | 54.3 |
| 23 | 0.61 | 1.53 | 0.88 | 0.12 | 5.98 | — | 0.86 | 0.21 | 0.0165 | | 56.9 |
| 24 | 0.82 | 1.02 | 1.34 | 0.17 | 0.95 | — | 0.74 | 0.07 | 0.0123 | | 50.4 |
| 25 | 0.70 | 1.10 | 1.10 | 0.06 | 1.02 | — | 0.35 | 0.02 | 0.0114 | | 55.3 |

*Nb, Ta, Ti, Ni, Cu, Co, Zr, Se, Ca, Al

With the exception of the comparative steel 19 in which a hardness not less than 50 HRC was not obtained, the cutting test was performed by use of a square end mill with respect to the samples of these steels. The test conditions are shown in Table 2. The machinability was evaluated by the cutting length obtained until the flank wear of a tool reaches 0.1 mm which is deemed to be the service life of the tool. The results of the evaluation of machinability are shown in Table 3.

TABLE

| Tool | 6-edge coated cemented carbide tool (8 mm in diameter) |
|---|---|
| Cutting speed | 30 m/min, 150 m/min |
| Feed speed | 0.06 mm/tooth |
| Depth of cut | 0.4 × 8 mm |
| Cutting direction | Down cut |
| Cutting oil | Dry type |

TABLE 3

| | Service Life of Tool | |
|---|---|---|
| No. | Cutting Speed: 30 m/min | Cutting Speed: 150 m/min |
| | Inventive Steels | |
| 1 | >150 m | 140 m |
| 2 | >150 m | >150 m |
| 3 | >150 m | >150 m |
| 4 | >150 m | >150 m |
| 5 | >150 m | 150 m |
| 6 | >150 m | >150 m |
| 7 | >150 m | 140 m |
| 8 | >150 m | >150 m |
| 9 | >150 m | 150 m |
| 10 | >150 m | >150 m |
| 11 | >150 m | >150 m |
| 12 | >150 m | >150 m |
| 13 | >150 m | 150 m |
| 14 | >150 m | 150 m |
| 15 | >150 m | >150 m |
| 16 | >150 m | 140 m |
| 17 | >150 m | >150 m |
| | Comparative Steels | |
| 18 | 40 m | 20 m |
| 20 | 130 m | 90 m |
| 21 | 150 m | 60 m |
| 22 | 100 m | 80 m |
| 23 | 120 m | 90 m |
| 24 | >150 m | 90 m |
| 25 | 60 m | 30 m |

In the working performed at a relatively low speed of 30 m/min, some of the comparative can be cut to some degree. However, in the high-speed cutting performed at a cutting speed of 150 m/min, the tool service life, i.e., the machinability of the steels of the invention is good, whereas the machinability of the comparative steels is inferior due to a high C content and a low Si content in the case of the comparative steel 18, due to a high C content in the case of the comparative steel 20, due to a low Si content in the case of the comparative steel 21, due to a low S content in the case of the comparative steel 22, and due to a high C content in the case of the comparative steel 23. The machinability of the comparative steel 24 is inferior due to a high C content although its hardness is somewhat low, and that of the comparative steel 25 is inferior due to a high C content and a low S content.

Embodiment 2

The cutting temperature at the time of the cutting by use of an end mill was measured regarding the prehardened steels of the inventive steel 1 and comparative steels 18 and 24 shown in Table 1. Each of the prehardened steels has a shape of sheet with a size of 40×50×200 mm. Table 4 shows the hardness, amount of carbides and amount of dissolved carbon regarding each of the inventive steel 2 and comparative steels 18 and 24, and Table 5 shows the cutting conditions and a method of measuring the cutting temperature. In general, it is natural that, when steels of the same chemical composition are compared, the lower the hardness, the lower the cutting temperature. Therefore, in this evaluation, the inventive steel 2 wad made to have a hardness higher than that of each of the comparative steels 18 and 24, so that it becomes clear that the effects of the working method of the invention are remarkable.

TABLE 4

| | No. | Hardness (HRC) | Amount of carbides (Area fraction) | Amount of dissolved carbon (mass %) |
|---|---|---|---|---|
| Inventive steel | 2 | 55.5 | Not more than 3% | About 0.35% |
| Comparative steel | 18 | 52.2 | 15% | About 0.60% |
| | 24 | 50.4 | Not more than 3% | About 0.80% |

TABLE 5

| Tool | 2-edge cemented carbide tool (6 mm in diameter) |
|---|---|
| Cutting speed | 30 m/min to 200 m/min |
| Feed speed | 0.04 mm/tooth |
| Depth of cut | 0.3 × 3 mm |
| Cutting direction | Down cut |
| Cutting oil | Dry type |

Measurement of the cutting speed: Thermocouple method between the tool and the steel sample FIG. 1 shows the results of the measurement of the cutting temperature. In the case of a cutting speed of 30 m/min, there was no substantial difference in the cutting temperature among the steel types. However, in compliance with the order of low hardness, the comparative steel 24 had the lowest cutting temperature, the comparative steel 18 having the next lower cutting temperature, and the inventive steel 2 had the retatively high cutting temperature. Next, in all of the steel types, the cutting temperature rises as the cutting speed increases. However, when the cutting speed exceeds about 50 m/min., a difference in the rising tendency of the cutting temperature comes to be clear. This depends on the concentration of the carbon present in a solid solution state in the matrix of the material. In the case of a cutting speed of 150 m/min, the cutting temperature is the lowest in the inventive steel 2 whose amount of dissolved carbon is about 0.35% by mass, which is the lowest level. The comparative steel 18 whose amount of dissolved carbon is about 0.860% by mass has the secondly lower cutting temperature, and the comparative steel 24 whose amount of dissolved carbon is about 0.80% by mass has the highest cutting temperature. The temperature difference among these steel types becomes a level of about 100° C.

In general, a high-hardness steel is usually cut by use of a tool coated with TiAlN. A factor which influences the service life of this coated tool is the oxidation-commencement temperature of the coating film, and in order to prolong the tool service life, it is naturally effective to perform the cutting of the steel at a cutting temperature not more than this oxidation-commencement temperature. The oxidation-commencement temperature of the coating film applied to the tool is generally about 800° C. In the case of the inventive steel 2, a cutting temperature not more than 800° C. is maintained even at a time when the cutting speed reaches 200 m/min., from which it is apparent that the inventive steel has excellent machinability.

Further, another factor which greatly influences the machinability is the distribution of carbides in the material. In the case of the comparative steel 18, much hard carbides are precipitated in addition to the above-described feature, so that abrasive wear occurs remarkably, which affect the machinability in a combined manner. Thus, as apparent from the results of Embodiment 1, the machinability of the comparative steel 18 is inferior to that of the inventive steel 2.

Embodiment 3

By using the prehardened materials of the inventive steel 2 and comparative steel 18, the fabrication test of a die was performed which die is assumed to be used for producing printed circuit boards. Each of the prehardened materials has a sheet shape having a size of 200×200×10 mm, and 100 holes each having a diameter of 1 mm were formed in each of the materials.

Regarding the comparative steel 18, the fabrication of a die was also performed by use of the steel of a state before the hardening and tempering, i.e., an annealed state. Namely, this is the currently generally adopted die-fabrication process, in which, after the piercing of the steel having the annealed state, dies were fabricated by performing the heat treatment of the hardening and tempering and then by performing the finishing working. The annealed material was made to have a size larger than the above prehardened material by 0.5 mm as a finishing allowance regarding each of the sides thereof. Regarding the heat treatment conditions of the annealed material, the hardening was performed at 1030° C. through vacuum-heatng, pressure-cooling, and the tempering was performed at 540° C.

In the above die fabrication, the piercing conditions (, as regards the comparative steel 18 from which dies were fabricated in an annealed state, the finishing working conditions) are shown in Table 6 and the man-hours needed from the piercing to the die fabrication are shown in Table 7.

TABLE 6

| | Inventive steel 2 (Preharden material) Piercing | Comparative steel18 (Preharden material) Piercing | Comparative steel18 (Annealed material) Finish working |
|---|---|---|---|
| Tool | Coated cemented carbide drill (diameter of 1 mm) | Coated high-speed drill (diameter of 1 mm) | Coated cemented carbide end mill, (diameter of 10 mm, 6-cutting edges) |
| Cutting speed | 12.5 m/min | 12.5 m/min | 20 m/min |
| Feed speed | 0.005 mm/rev | 0.005 mm/rev | 0.03 mm/tooth |
| Step feed | 0.05 mm (Returns to the inlet) | None | — |
| Depth of cut | — | — | (0.2 – 0.5) × 10 mm |
| Cutting oil | Water-soluble | Water-soluble | Dry type |

TABLE 7

| | | Man-hours (hour) | | | |
|---|---|---|---|---|---|
| Material | Hardness (HRC) | Piercing | Heat treatment | Finishing working | Total |
| Inventive steel 2 (Preharden material) | 55.5 | 5 | Unneces-sary | Unneces-sary | 5 |
| Comparative steel 18 (Preharden material) | 52.2 | Drill was broken in the 30th holes. | — | — | — |
| Comparative steel 18 (Annealed material) | ※57.1 | 1 | 10 | 0.5 | 11.5 |

※The hardness of the comparative steel 18 (annealed material) is a value obtained after the heat treatment.

In the piercing of the prehardened material of the comparative steel 18, the drill was broken at the 30th hole and die fabrication became impossible. In the currently usually adopted die-fabrication process in which the dies were fabricated from an annealed material, in the case of the comparative steel 18 it was necessary to perform a heat treatment after the piercing and the finishing working due to the occurrence of size-changing, resulting in an increase in man-hours.

On the other hand, in the case of die fabrication by the prehardened material of the inventive steel 2, it was possible to perform the piercing after the quenching and tempering and besides it was unnecessary to perform any heat treatment after the piercing and finishing working, thereby making it possible to substantially reduce the fabrication cost. Even if, in the die fabrication by use of the annealed material of the comparative steel 18, the cutting efficiency is made to increase by using a cemented carbide drill in the piercing, the man-hours for this die fabrication do not attain those of the die fabrication by the prehardened material of the inventive steel 2.

As described above, in the steels of the invention, it is possible to obtain a hardness not less than 50 HRC or not less than 55 HRC necessary for producing the dies for cold working, such as blanking, and the machinability thereof is good at the high hardness state even in a so-called prehardened state obtained after the hardening and tempering. Therefore, an improvement in the die-fabrication efficiency and a cost reduction resulting from this improvement can be achieved. The industrial value obtained by the invention is high.

What is claimed is:

1. A high-hardness prehardened steel for cold working having excellent machinability, containing, by mass, not less than 0.3% but less than 0.5% C, 0.7 to 2.0% Si, and 0.08 to 0.25% S, said steel for cold working being hardened and tempered to have a hardness more than 50 HRC.

2. A high-hardness prehardened steel for cold working having excellent machinability according to claim 1, said steel for cold working being hardened and tempered to have a hardness not less than 55 HRC.

3. A high-hardness prehardened steel for cold working having excellent machinability according to claim 1, said prehardened steel being subjected to cutting working after said steel had been hardened and tempered, and a speed of said cutting working being not less than 50 m/min.

4. A high-hardness prehardened steel for cold working having excellent machinability according to claim 2, said prehardened steel being subjected to cuffing working after said steel had been hardened and tempered, and a speed of said cutting working being not less than 50 m/min.

5. A high-hardness prehardened steel for cold working having excellent machinability, consisting, by mass, of not less than 0.3% but less than 0.5% C, 0.7 to 2.0% Si, 0.1 to 2.0% Mn, 0.08 to 0.25% S, 0.5 to 15.0% Cr, at least one selected from the group consisting of W and Mo an amount of which at least one is not more than 3.5% in total in terms of (Mo+1/2W), not more than 4.0% V, not more than 0.15% N, and the balance Fe and incidental impurities, said steel for cold working being hardened and tempered to have a hardness more than 50 HRC.

6. A high-hardness prehardened steel according to claim 5, said steel for cold working being hardened and tempered to have a hardness not less than 55 HRC.

7. A high-hardness prehardened steel according to claim 5, said prehardened steel being subjected to cutting working after said steel had been hardened and tempered, and a speed of said cutting working being not less than 50 m/min.

8. A high-hardness prehardened steel for cold working having excellent machinability, consisting, by mass, of not less than 0.3% to 0.45% C, 0.8 to 2.0% Si, 0.1 to 2.0% Mn, 0.08 to 0.25% S, 4.0 to 6.0% Cr, at least one selected from the group consisting of W and Mo an amount of which at least one is not more than 2.0% in total in terms of (Mo+1/2W), not more than 1.0% V, not less than 0.01% but not more than 0.15% N, and the balance Fe and incidental impurities, said steel for cold working being hardened and tempered to have a hardness more than 50 HRC.

9. A high-hardness prehardened steel according to claim 8, said steel for cold working being hardened and tempered to have a hardness not less than 55 HRC.

10. A high-hardness prehardened steel according to claim 8, said prehardened steel being subjected to cutting working after said steel had been hardened and tempered, and a speed of said cutting working being not less than 50 m/min.

11. A high-hardness prehardened steel for cold working having excellent machinability, consisting, by mass, of: not less than 0.3% but less than 0.5% C; 0.7 to 2.0% Si; 0.1 to 2.0% Mn; 0.08 to 0.25% S; 0.5 to 15.0% Cr; at least one selected from the group consisting of W and Mo an amount of which at least one is not more than 3.5% in total in terms of (Mo+1/2W); not more than 4.0% V, not more than 0.15% N; at least one of first optional elements selected from the group consisting of Nb, Ta and Ti an amount of which at least one is not more than 0.4% by mass in total; at least one of second optional elements selected from the group consisting of not more than 4.0% Ni, not more than 2.0% Cu, not more than 5.0% Co, not more than 0.2% Zr, not more than 0.15% Se, not more than 100 ppm Ca, not more than 1.5% Al; and the balance Fe and incidental impurities, said steel for cold working being hardened and tempered to have a hardness more than 50 HRC.

12. A high-hardness prehardened steel for cold working having excellent machinability, consisting, by mass, of: not less than 0.3% to 0.45% C; 0.8 to 2.0% Si; 0.1 to 2.0% Mn; 0.08 to 0.25% S; 4.0 to 6.0% Cr; at least one selected from the group consisting of W and Mo an amount of which at least one is not more than 2.0% in total in terms of (Mo+1/2W); not more than 1.0% V; not less than 0.01% but not more than 0.15% N; at least one of first optional elements selected from the group consisting of Nb, Ta and Ti an amount of which at least one is not more than 0.4% by mass in total; at least one of second optional elements selected from the group consisting of not more than 4.0% Ni, not more than 2.0% Cu, not more than 5.0% Co, not more than 0.2% Zr, not more than 0.15% Se, not more than 100 ppm Ca, not more than 1.5% Al; and the balance Fe and incidental impurities, said steel for cold working being hardened and tempered to have a hardness more than 50 HRC.

13. A die for cold working, said die being made of a high-hardness prehardened steel for cold working having excellent machinability, said steel containing, by mass, not less than 0.3% but less than 0.5% C, 0.7 to 2.0% Si, and 0.08 to 0.25% S, said steel being hardened and tempered to have a hardness more than 50 HRC, and said steel being then subjected to cutting working.

14. A die for cold working, said die being made of a high-hardness prehardened steel for cold working having excellent machinability, said steel consisting, by mass, of: not less than 0.3% but less than 0.5% C; 0.7 to 2.0% Si; 0.1 to 2.0% Mn; 0.08 to 0.25% S; 0.5 to 15.0% Cr; at least one selected from the group consisting of W and Mo an amount of which at least one is not more than 3.5% in total in terms of (Mo+1/2W); not more than 4.0% V; not more than 0.15% N; and the balance Fe and incidental impurities, said steel being hardened and tempered to have a hardness more than 50 HRC, and said steel being then subjected to cutting working.

15. A die for cold working, said die being made of high-hardness prehardened steel for cold working having excellent machinability, said steel consisting, by mass, of: not less than 0.3% to 0.45% C, 0.8 to 2.0% Si, 0.1 to 2.0% Mn, 0.08 to 0.25% S, 4.0 to 6.0% Cr, at least one selected from the group consisting of W and Mo an amount of which at least one is not more than 2.0% in total in terms of (Mo+1/2W), not more than 1.0% V, not less than 0.01% but not more than 0.15% N, and the balance Fe and incidental impurities, said steel being hardened and tempered to have a hardness more than 50 HRC, and said steel being then subjected to cutting working.

16. A die for cold working, said die being made of a high-hardness prehardened steel for cold working having excellent machinability, said steel consisting, by mass, of: not less than 0.3% but less than 0.5% C; 0.7 to 2.0% Si; 0.1 to 2.0% Mn; 0.08 to 0.25% S; 0.5 to 15.0% Cr; at least one selected from the group consisting of W and Mo an amount of which at least one is not more than 3.5% in total in terms of (Mo+1/2W); not more than 4.0% V, not more than 0.15% N; at least one of first optional elements selected from the group consisting of Nb, Ta and Ti an amount of which at least one is not more than 0.4% by mass in total; at least one of second optional elements selected from the group consisting of not more than 4.0% Ni, not more than 2.0% Cu, not more than 5.0% Co, not more than 0.2% Zr, not more than 0.15% Se, not more than 100 ppm Ca, not more than 1.5% Al; and the balance Fe and incidental impurities, said steel being hardened and tempered to have a hardness more than 50 HRC, and said steel being then subjected to cutting working.

17. A method of working a high-hardness prehardened steel having excellent machinability, comprising the steps of:

preparing said prehardened steel which is hardened and tempered to have a hardness more than 50 HRC, said steel containing, by mass, not less than 0.3% but less than 0.5% C, 0.7 to 2.0% Si, and 0.08 to 0.25% S; and cutting said prehardened steel at a cutting speed not less than 50 m/min.

18. A method of working a high-hardness prehardened steel having excellent machinability, comprising the steps of:

preparing said prehardened steel which is hardened and tempered to have a hardness more than 50 HRC, said steel consisting, by mass, of not less than 0.3% but less than 0.5% C, 0.7 to 2.0% Si, 0.1 to 2.0% Mn, 0.08 to 0.25% S, 0.5 to 15.0% Cr, at least one selected from the group consisting of W and Mo an amount of which at least one is not more than 3.5% in total in terms of (Mo+1/2W), not more than 4.0% V, not more than 0.15% N, and the balance Fe and incidental impurities; and cutting said prehardened steel at a cutting speed more than 50 m/min.

19. A method of working a high-hardness prehardened steel having excellent machinability, comprising the steps of:

preparing said prehardened steel which is hardened and tempered to have a hardness more than 50 HRC, said steel consisting, by mass, of not less than 0.3% to 0.45% C, 0.8 to 2.0% Si, 0.1 to 2.0% Mn, 0.08 to 0.25% S, 4.0 to 6.0% Cr, at least one selected from the group consisting of W and Mo an amount of which at least one is not more than 2.0% in total in terms of (Mo+1/2W), not more than 1.0% V, not less than 0.01% but not more than 0.15% N, and the balance Fe and incidental impurities; and cutting said prehardened steel at a cutting speed not less than 50 m/min.

20. A method of working a high-hardness prehardened steel having excellent machinability, comprising the steps of:

preparing said prehardened steel which is hardened and tempered to have a hardness more than 50 HRC, said steel consisting, by mass, of: not less than 0.3% but less than 0.5% C; 0.7 to 2.0% Si; 0.1 to 2.0% Mn; 0.08 to 0.25% S; 0.5 to 15.0% Cr; at least one selected from the group consisting of W and Mo an amount of which at least one is not more than 3.5% in total in terms of (Mo+1/2W); not more than 4.0% V, not more than 0.15% N; at least one of first optional elements selected from the group consisting of Nb, Ta and Ti an amount of which at least one is not more than 0.4% by mass in total; at least one of second optional elements selected from the group consisting of not more than 4.0% Ni, not more than 2.0% Cu, not more than 5.0% Co, not more than 0.2% Zr, not more than 0.15% Se, not more than 100 ppm Ca, not more than 1.5% Al; and the balance Fe and incidental impurities,; and cutting said prehardened steel at a cutting speed not less than 50 m/min.

21. The high-hardness prehardened steel for cold working having excellent machinability of claim 1, wherein the steel is produced by a process which comprises melting and ingot molding.

* * * * *